US006558130B1

(12) United States Patent
Chang

(10) Patent No.: US 6,558,130 B1
(45) Date of Patent: May 6, 2003

(54) TWO-WAY MANUALLY OPERATED PUMP STRUCTURE

(76) Inventor: Hsueh Chin Chang, P.O. Box 63-150, Taichung City (406) (TW)

( * ) Notice: Subject to any disclaimer, the term of this patent is extended or adjusted under 35 U.S.C. 154(b) by 0 days.

(21) Appl. No.: 10/241,231

(22) Filed: Sep. 8, 2002

(30) Foreign Application Priority Data

Jun. 17, 2002 (TW) ..... 091209136 A

(51) Int. Cl.[7] ..... F04B 41/00
(52) U.S. Cl. ..... 417/63; 417/440; 417/441
(58) Field of Search ..... 417/63, 440, 441, 417/305, 306; 222/3

(56) References Cited

U.S. PATENT DOCUMENTS 4,565,506 A * 1/1986 Williams ..... 417/440
5,478,216 A * 12/1995 Neward ..... 417/440

* cited by examiner

*Primary Examiner*—Philippe Derakshani

(57) ABSTRACT

A two-way manually operated pump structure consisting of a pump body, a nozzle mount, a control ring mount, and other structural components that are assembled together, in which rotating the control ring mount shifts the air direction between them and thereby enables manual inflation and deflation operation.

2 Claims, 5 Drawing Sheets

TWO-WAY MANUALLY OPERATED PUMP STRUCTURE

BACKGROUND OF THE INVENTION

1) Field of the Invention

The invention herein relates to pumping device, specifically a two-way manually operated pump structure.

2) Description of the Prior Art

Since conventional hand-operated pumps now available are of one-way inflation designs, their scope of application is limited to pumping air. In other applications, such as the DIY automotive maintenance market, where a deflating vacuum is a daily necessity, existent hand-operated pumps are incapable of such a function.

In view of the said situation, the inventor of the invention herein conducted extensive research and experimentation based on many years experience gained in the production and sales of similar category products which culminated in the successful development of the practical invention herein.

SUMMARY OF THE INVENTION

The primary objective of the invention herein is to provide a two-way manually operated pump structure that is capable of both inflation and deflation tasks.

Therefore, based on the two-way manually operated pump structure of the invention herein, the present invention is comprised of:

A pump body having a handle at its exterior side that provides for manual gripping support, a piston chamber disposed lengthwise, the interior of the said piston chamber providing for the longitudinal excursion of a piston, a piston connecting rod at the center axial end of and, furthermore, coupled to the said piston, with the far extremity of the said piston connecting rod extending through the piston chamber exposed at its outer side.

A nozzle mount conjoined in an air-tight seal to the front end opening of the said piston chamber consisting of an intake passage and an exhaust passage formed lengthwise and, furthermore, independently in continuity with the said piston chamber, a unidirectional valve situated in a passage opening at the juncture of the said intake passage and the piston chamber that limits the admittance of air in the said piston chamber through the intake passage to a single direction, a unidirectional valve situated in a passage opening at the juncture of the exhaust passage and the piston chamber that limits the admittance of air in the piston chamber through the said exhaust passage to a single direction; furthermore, a pressure gauge is radially disposed in the upper side of the said nozzle mount and a nozzle projects lengthwise from its anterior extremity; the said nozzle consists of a vent tube that is in continuity lengthwise with internal pressure of the pressure gauge and a vent hole is radially and recessively formed through the interior section of the vent tube.

A drive mechanism consisting of a bracing fixture, a push handle, an elastic component, and a collapsible sleeve, of which the said bracing fixture is situated at an angle on the pump body such that the outer diameter of the handle at the opposite side is aligned with it and, furthermore, a pivot hole is formed in its lengthwise extremity; the said push handle has a top end equipped with a pin that is hinged to the said pivot hole, wherein a joint section disposed in the lateral portion has a pin for linkage and fastening to the said connecting rod extremity to enable the driving of and control over the forward and rearward excursion of the piston; the said elastic component is installed lengthwise over the outer diameter of the said piston connecting rod exposed at the outer surface of the pump body and provides the rebound force for the longitudinal movement of the piston; and the said collapsible sleeve is slipped lengthwise over the outer diameter of the said elastic component to provide for the protection of this area.

A control ring mount that provides for tight rotational conjoinment to the end surface of the said nozzle mount and has an axial hole at the center of its lengthwise end that is, furthermore, aligned with the outer diameter of the said nozzle, a circular slot recessively formed in alignment with the vent hole position of the nozzle and the internal diameter of the axial hole, and an intake port and an exhaust port recessively formed proximal to the nozzle mount at the lateral extremity of the control ring mount end surface that are respectively aligned with its intake passage and exhaust passage end positions, wherein the opposite end of the said intake port extends to the outer diameter and upper side of the said control ring mount such that it is in continuity with external air, while the opposite end of the said exhaust port is in continuity with the said circular slot such that air flows confluently within the said nozzle vent tube and the said circular slot.

Given the said assembly, the angular rotation and adjustment operation of the said control ring mount shifts the positions of the intake port and the exhaust port in its end surface aligned in an air-tight confluence with the intake passage and the exhaust passage formed lengthwise in the nozzle mount and changes the air admittance passage flow pattern orientation appropriate for the inflation or deflation.

To enable a further understanding by the examination committee of the objectives, features, and functions of the present invention, the brief description of the drawings below are followed by the detailed description of the invention herein.

DETAILED DESCRIPTION OF THE INVENTION

Figure 1:
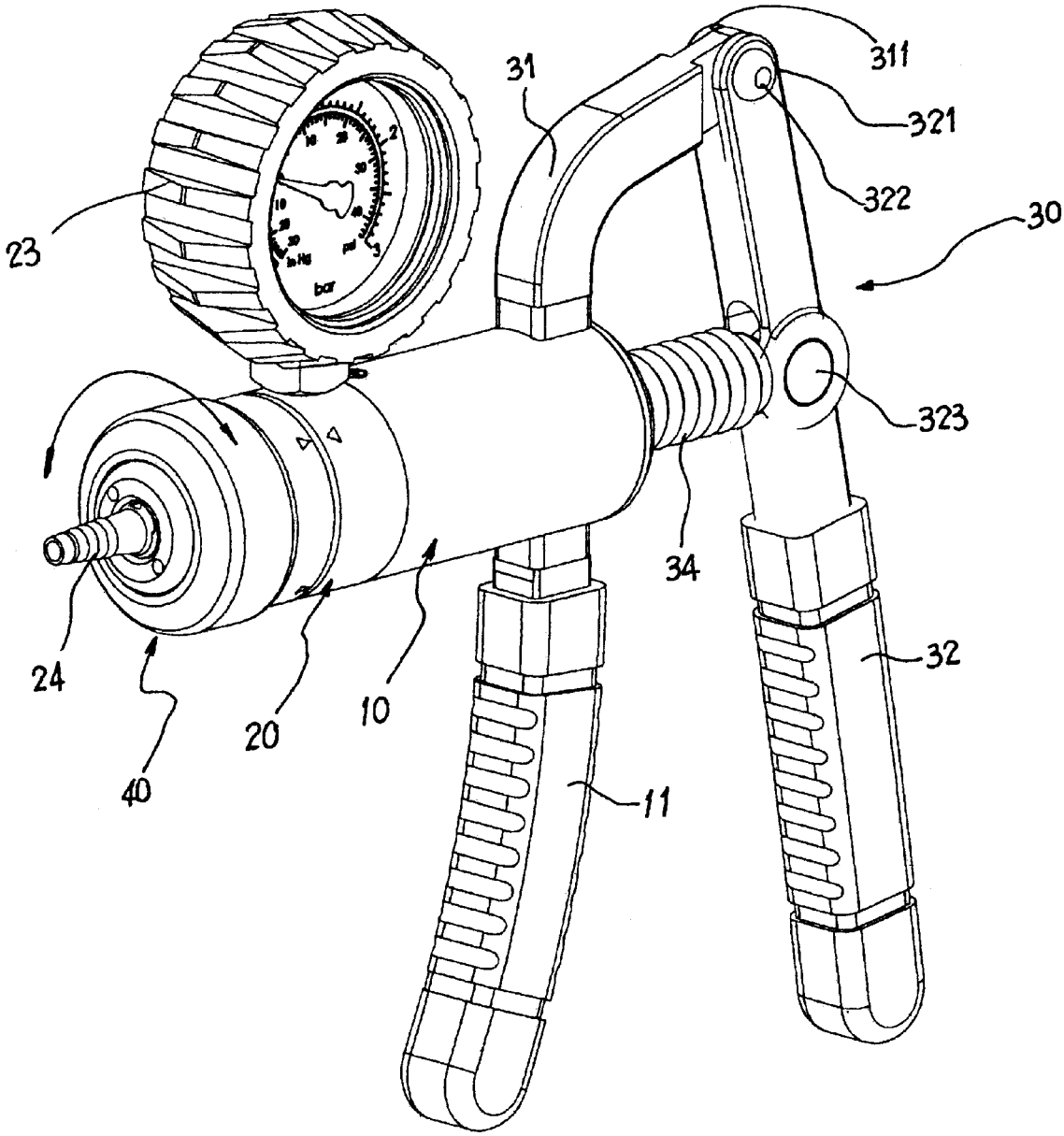
FIG. 1 is an isometric drawing of the most preferred embodiment of the invention herein.

Referring to FIG. 1, FIG. 2, FIG. 3, FIG. 4, and FIG. 5, the invention herein is a two-way manually operated pump structure comprised of a pump body 10, a nozzle mount 20, a drive mechanism 30, and a control ring mount 40, wherein:

The said pump body 10 is tube-shaped and has a handle 11 at the bottom side of its outer diameter that provides for manual gripping support, a piston chamber 12 disposed lengthwise, the interior of the said piston chamber 12 providing for the longitudinal excursion of a piston 13, a piston connecting rod 14 at the center axial end of and, furthermore, coupled to the said piston 13, with the far extremity 141 of the said piston connecting rod 14 extending through the piston chamber 12 exposed at the outer side of the pump body 10.

Figure 2:
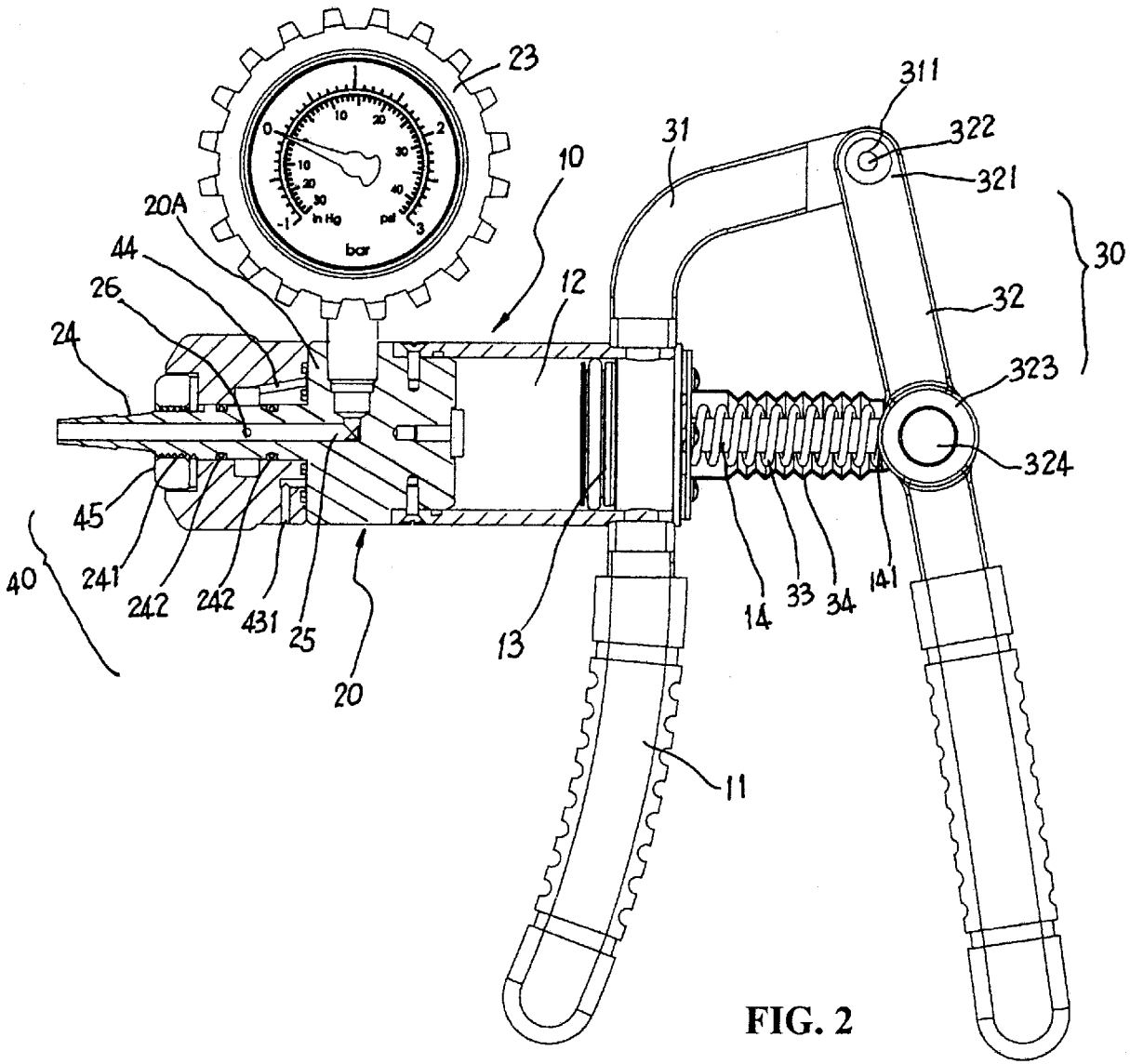
FIG. 2 is a cross-sectional drawing of the most preferred embodiment of the invention herein.
Figure 4:
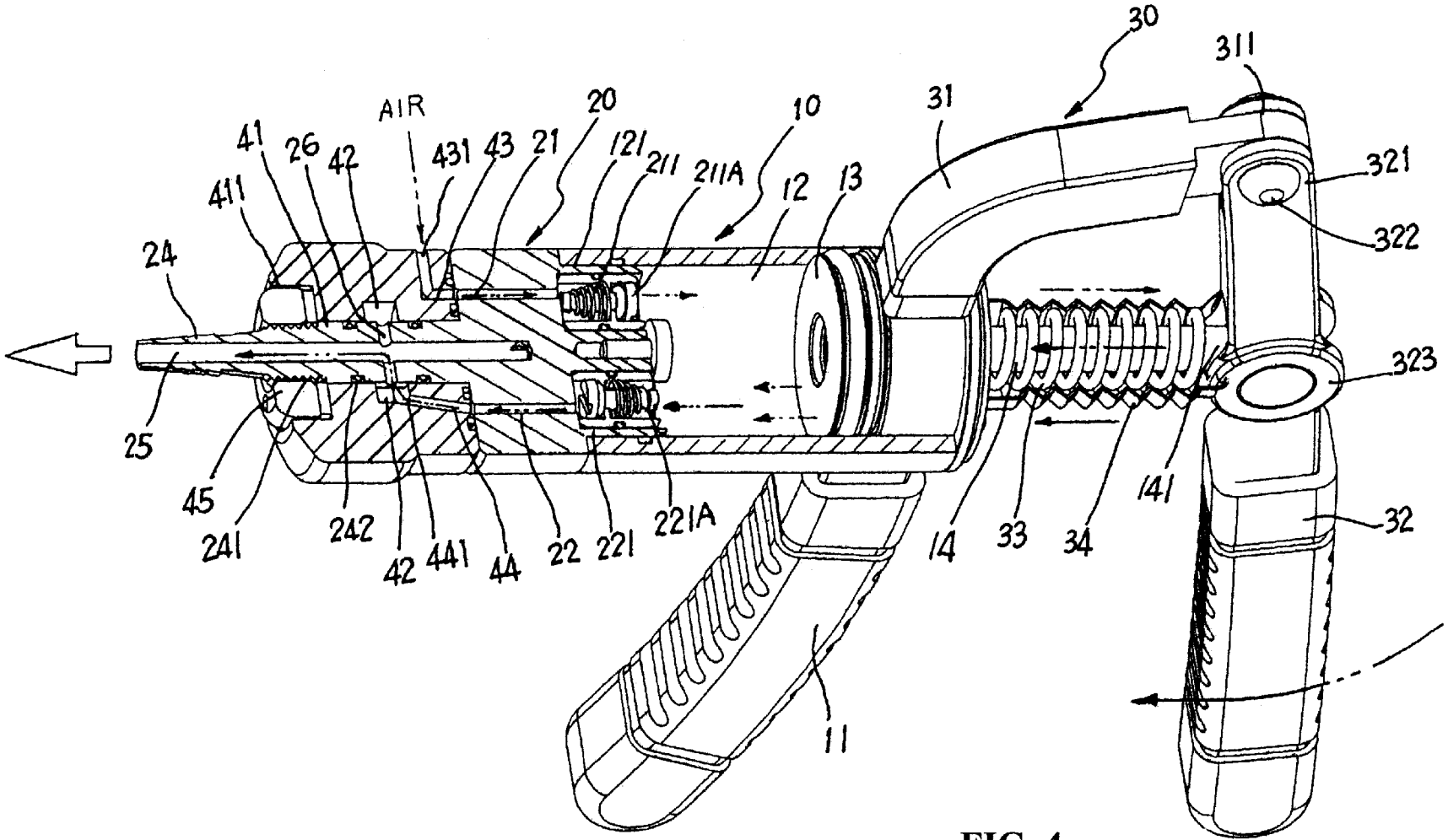
FIG. 4 is a cross-sectional drawing of the invention herein that illustrates the inflation operation.
Figure 5:
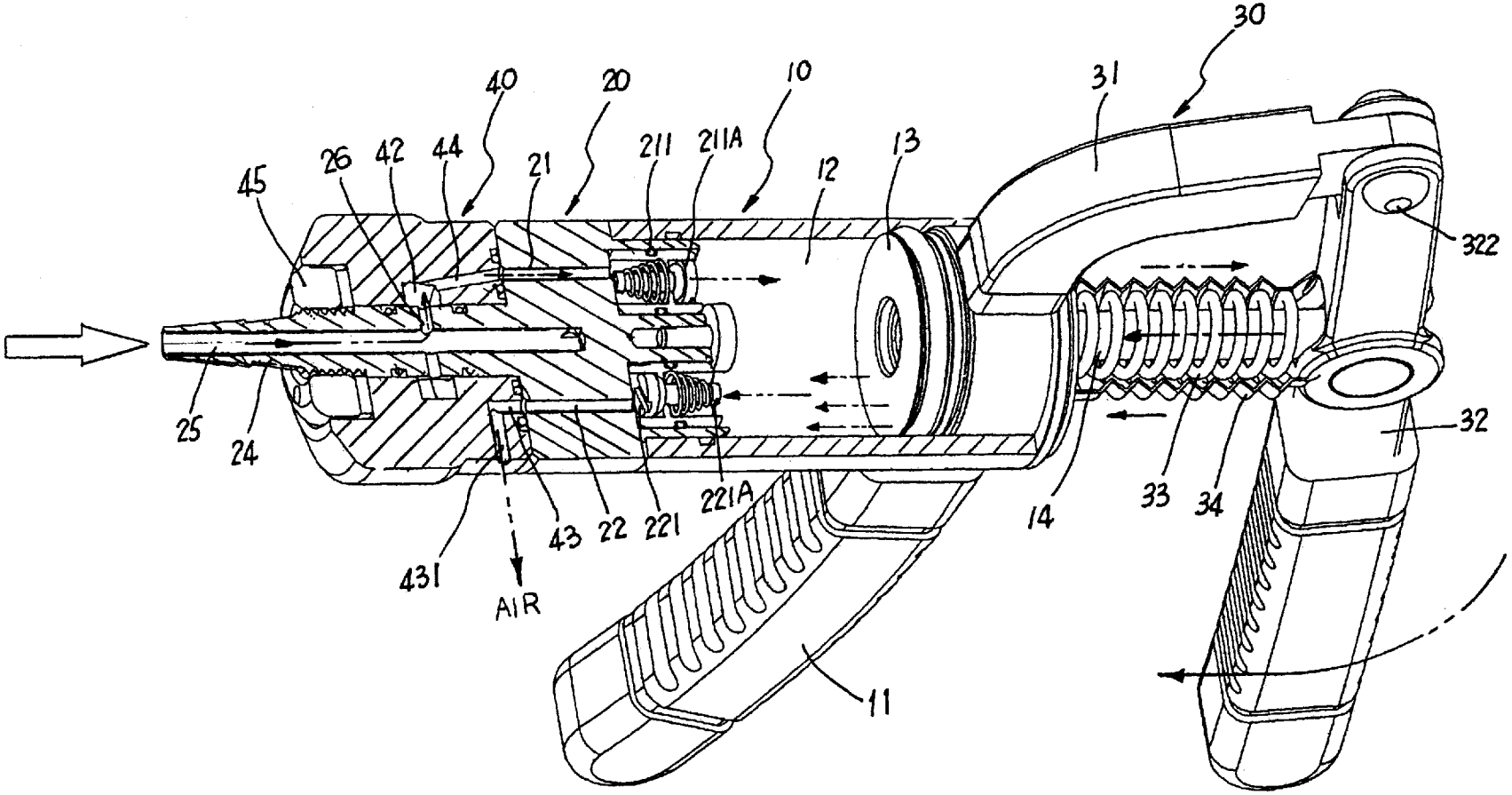
FIG. 5 is a cross-sectional drawing of the invention herein that illustrates the deflation operation.

The said nozzle mount 20 is tube-shaped and, as indicated in FIG. 4, FIG. 5, conjoined in an air-tight seal to the front end opening 121 of the said piston chamber 12 consisting of an intake passage 21 and an exhaust passage 22 formed lengthwise and, furthermore, independently in continuity with the interior section of the said piston chamber 12, a unidirectional valve 211A situated in a passage opening 211 at the juncture of the said intake passage 21 and the piston chamber 12 that limits the admittance of air in the said piston chamber 12 through the intake passage 21 to a single direction, a unidirectional valve 221A situated in a passage opening 221 at the juncture of the exhaust passage 22 and the piston chamber 12 that limits the admittance of air in the piston chamber 12 through the said exhaust passage 22 to a single direction; furthermore, as indicated in FIG. 1 and FIG. 2, a pressure gauge 23 is radially disposed in the upper side of the said nozzle mount 20 and a nozzle 24 projects lengthwise from its anterior extremity 20A; the said nozzle 24 consists of a vent tube 25 that is in continuity lengthwise with internal pressure of the pressure gauge 23, a vent hole 26 is radially and recessively formed through the interior section of the vent tube 25, and external threads 241 and a leak-proof ring 242 are respectively formed and placed at the front and rear outer diameter of its forward end.

The said drive mechanism 30 consists of a bracing fixture 31, a push handle 32, an elastic component 33, and a collapsible sleeve 34, of which the said bracing fixture 31 is situated at an angle on the pump body 10 such that the outer diameter of the handle 11 at the opposite side is aligned with it and, furthermore, a pivot hole 311 is formed in its lengthwise extremity; the said push handle 32 has a top end 321 equipped with a pin 322 that is hinged to the said pivot hole 311, wherein a joint section 323 disposed in the lateral portion has a pin 324 for linkage and fastening to the said connecting rod 14 extremity 141 to enable the driving of and control over the forward and rearward excursion of the piston 13; the said elastic component 33 is installed lengthwise over the outer diameter of the said piston connecting rod 14 exposed at the outer surface of the pump body 10 and provides the rebound force for the longitudinal movement of the piston 13; and the said collapsible sleeve 34 is slipped lengthwise over the outer diameter of the said elastic component 33 to provide for the protection of this area.

Figure 3:
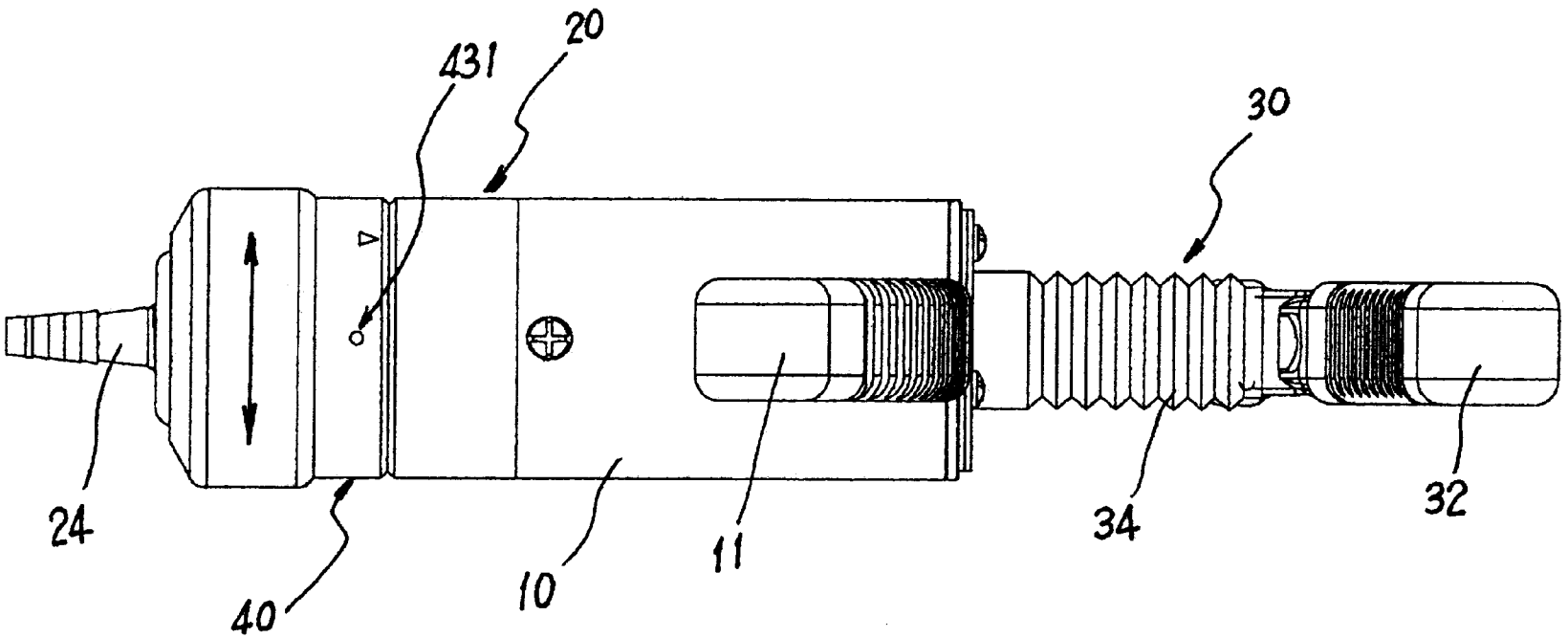
FIG. 3 is an orthographic drawing of the invention herein, as viewed from a bottom perspective.

The said control ring mount 40 is annular in shape and, as indicated in FIG. 4, has an axial hole 41 at the center of its lengthwise end that is, furthermore, aligned in continuity with the outer diameter of the said nozzle 24, thereby providing for confluence with the said nozzle 24, a circular slot 42 recessively formed in alignment with the vent hole 26 position of the nozzle 24 and the internal diameter of the axial hole 41, and an intake port 43 and an exhaust port 44 recessively formed proximal to the nozzle mount 20 at the lateral extremity of the control ring mount 40 end surface that are respectively aligned with its intake passage 21 and exhaust passage 22 end positions, wherein the opposite end 431 of the said intake port 43 extends to the outer diameter and upper side of the said control ring mount 40, as indicated in FIG. 3, such that it is in continuity with external air, while the opposite end 441 of the said exhaust port 44 is in continuity with the said circular slot 42 such that air flows confluently within the said nozzle 24 vent tube 25 and the said circular slot 42; furthermore, a fish eye concavity 411 is formed by radial distension at the front end of the said control ring mount 40 axial hole 41, the said fish eye concavity 411 utilized to seat a locating nut 45 such that the external threads 241 along the outer diameter of the said nozzle 24 are fastened in an air-tight sealed conjoinment to the control ring mount 40 at the front end surface of the nozzle mount 20 and, furthermore, maintain an appropriate magnitude of rotational torque at a set angle of rotational movement.

Given the said assembly and the resultant two-way manually operated pump structure of the invention herein, as indicated in FIG. 1 and FIG. 3, since the end surface of the said control ring mount 40 is conjoined in an air-tight seal to the nozzle mount 20 and, furthermore, the intake port 43 and the exhaust port 44 in its end surface are respectively aligned in an air-tight confluence with the intake passage 21 and the exhaust passage 22 formed lengthwise in the nozzle mount 20, the angular rotation and adjustment operation of the said control ring mount 40 shifts the positions of the aligned confluent ports and passages, and changes the air admittance passage flow pattern orientation appropriate for inflation or deflation, with the operation explained as follows:

When the user wants to execute general inflation tasks, as indicated in FIG. 4, the intake port 43 at the end surface of the said control ring mount 40 is in air-tight confluence with the nozzle mount 20 intake passage 21, while its exhaust port 44 is positionally aligned in continuity with the said nozzle mount 20 exhaust passage 22; therefore, when the user grasps the handle 11 and operates the push handle 32 at its rear side by squeezing, the said piston 13 is impelled forward lengthwise by the coupled connecting rod 14 and, as a result, compresses air in the piston chamber 12 through the unidirectional valve 221A situated in a single guided direction to the exhaust passage 22 of the nozzle mount 20 and the circular slot 42, and then through the vent hole 26 contiguous with the said circular slot 42 to interior section of the vent tube 25, following which the air is pumped lengthwise through the said nozzle 24 into the item to be inflated; during the said process, since the unidirectional valve 211A situated in a passage opening 211 at the limits the admittance of air into the said piston chamber 12 to a single direction, external air is continuously drawn in from the opposite end 431 of intake port 43 in contact with air outside; as such, the reciprocal operation of the push handle 32 is capable of continuously pumping air until the desired inflation reading is shown on the pressure gauge 23.

Conversely, when the user wants to execute general deflation tasks, as indicated in FIG. 1 and FIG. 5, since the said control ring mount 40 is of an adjustable arrangement, it is rotated to an indicator on the outer side demarking the inflation position, thereby shifting the intake port 43 and exhaust port 44 at its interior section from their said original positions; as such, the exhaust port 44 at the end surface of the said control ring mount 40 is in air-tight confluence with the nozzle mount 20 intake passage 21, while its intake port 43 is positionally aligned in continuity with the said nozzle mount 20 exhaust passage 22; therefore, when the user grasps the handle 11 and operates the push handle 32 at its rear side by squeezing, the said piston 13 is impelled forward lengthwise by the coupled connecting rod 14 and, as a result, compresses air in the piston chamber 12 through the unidirectional valve 221A in a single guided direction to the exhaust passage 22 of the nozzle mount 20, with the air finally discharged from the confluent intake port 43 through its opposite end 431; as the piston 13 is continuously compressed and decompressed, the passage opening 211 situated inside the other unidirectional valve 211A synchronously generates a vacuum suctioning force that simultaneously draws air into the said piston chamber 12 through the intake passage 21 confluent with the exhaust port 44; since the vent tube 25 and the vent hole 26 are in continuity with the exhaust port 44 during the suction process, air is drawn and guided synchronously through the nozzle 24 into the piston chamber 12; as such, the reciprocal operation of the push handle 32 is capable of continuously pumping out air until the desired deflation reading is shown on the pressure gauge 23.

In summation of the foregoing section, the technical concept and original spatial arrangement of the two-way manually operated pump structure of the invention herein overcomes the conventional drawbacks and is capable of both inflation and deflation operation to provide a multi-functional hand operated pump that is performance-wise more practical than conventional structures.

What is claimed is:

1. A two-way manually operated pump structure comprised of:

A pump body having a handle at its exterior side that provides for manual gripping support, a piston chamber disposed lengthwise, the interior of the said piston chamber providing for the longitudinal excursion of a piston, a piston connecting rod at the center axial end of and, furthermore, coupled to the said piston, with the far extremity of the said piston connecting rod extending through the said piston chamber exposed at its outer side;

A nozzle mount conjoined in an air-tight seal to the front end opening of the said piston chamber consisting of an intake passage and an exhaust passage formed lengthwise and, furthermore, independently in continuity with the said piston chamber, a unidirectional valve situated in a passage opening at the juncture of the said intake passage and the said piston chamber that limits the admittance of air in the said piston chamber through the said intake passage to a single direction, a unidirectional valve situated in a passage opening at the juncture of the said exhaust passage and the said piston chamber that limits the admittance of air in the said piston chamber through the said exhaust passage to a single direction; furthermore, a pressure gauge is radially disposed in the upper side of the said nozzle mount and a nozzle projects lengthwise from its anterior extremity; the said nozzle consists of a vent tube that is in continuity lengthwise with internal pressure of the said pressure gauge and a vent hole is radially and recessively formed through the interior section of the said vent tube;

A drive mechanism consisting of a bracing fixture, a push handle, an elastic component, and a collapsible sleeve, of which the said bracing fixture is situated at an angle on the said pump body such that the outer diameter of the said handle at the opposite side is aligned with it and, furthermore, a pivot hole is formed in its lengthwise extremity; the said push handle has a top end equipped with a pin that is hinged to the said pivot hole, wherein a joint section disposed in the lateral portion has a pin for linkage and fastening to the said connecting rod extremity to enable the driving and control over the forward and rearward excursion of the said piston; the said elastic component is installed lengthwise over the outer diameter of the said piston connecting rod exposed at the outer surface of the said pump body and provides the rebound force for the longitudinal movement of the said piston; and the said collapsible sleeve is slipped lengthwise over the outer diameter of the said elastic component to provide for the protection of this area;

A control ring mount that provides for tight rotational conjoinment to the end surface of the said nozzle mount and has an axial hole at the center of its lengthwise end that is, furthermore, aligned with the outer diameter of the said nozzle, a circular slot recessively formed in alignment with the said vent hole position of the said nozzle and the internal diameter of the said axial hole, and an intake port and an exhaust port recessively formed proximal to the said nozzle mount at the lateral extremity of the said control ring mount end surface that are respectively aligned with its said intake passage and said exhaust passage end positions, wherein the opposite end of the said intake port extends to the outer diameter and upper side of the said control ring mount such that it is in continuity with external air, while the opposite end of the said exhaust port is in continuity with the said circular slot such that air flows confluently within the said nozzle vent tube and the said circular slot;

Given the said assembly, the angular rotation and adjustment operation of the said control ring mount shifts the positions of the said intake port and the said exhaust port in its end surface aligned in an air-tight confluence with the said intake passage and the said exhaust passage formed lengthwise in the said nozzle mount and changes the air admittance passage flow pattern orientation appropriate for the inflation or deflation.

2. As mentioned in claim 1 of the two-way manually operated pump structure invention herein, the said nozzle has external threads along the outer diameter of its front end and the said control ring mount has a fish eye concavity formed at the front end of its said axial hole, with the said fish eye concavity utilized to seat a locating nut such that the said external threads along the outer diameter of the said nozzle are fastened in an air-tight sealed conjoinment to the said control ring mount at the front end surface of the said nozzle mount and, furthermore, maintain an appropriate magnitude of rotational torque at a set angle of rotation.

* * * * *